US006131924A

United States Patent [19]

Marmonier

[11] Patent Number: 6,131,924

[45] **Date of Patent: *Oct. 17, 2000**

[54] ROLLER OR ICE SKATE

[75] Inventor: Gilles Marmonier, Saint Etienne de Crossey, France

[73] Assignee: Skis Rossignol S.A., Voiron, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/957,081

[22] Filed: Oct. 24, 1997

[30] Foreign Application Priority Data

Oct. 25, 1996 [FR] France ..... 96 13284

[51] Int. Cl.[7] ..... A63C 1/18

[52] U.S. Cl. ..... 280/11.3; 280/11.22; 36/115

[58] Field of Search ..... 280/11.22, 11.3, 280/11.31, 841, 842, 11.19, 623, 631, 636; 36/115

[56] References Cited

U.S. PATENT DOCUMENTS

| | | | |
|---|---|---|---|
| 175,250 | 3/1876 | McDonald | 280/11.3 |
| 3,649,038 | 3/1972 | Huckenbeck | 280/11.28 |
| 4,072,317 | 2/1978 | Pommerening | 280/11.23 |
| 5,171,033 | 12/1992 | Olson et al. | 280/11.22 |
| 5,331,752 | 7/1994 | Johnson et al. | 36/115 |
| 5,397,141 | 3/1995 | Hoshizaki et al. | 280/11.3 |
| 5,408,763 | 4/1995 | Sartor et al. | 36/115 |
| 5,487,552 | 1/1996 | Daoust | 280/11.2 |
| 5,595,396 | 1/1997 | Bourdeau | 280/607 |
| 5,645,288 | 7/1997 | Lu | 280/11.26 |
| 5,664,344 | 9/1997 | Marmonier | 36/118.2 |
| 5,701,689 | 12/1997 | Hansen et al. | 36/115 |
| 5,769,446 | 6/1998 | Borsoi | 280/623 |
| 5,820,139 | 10/1998 | Grindl | 280/14.2 |

FOREIGN PATENT DOCUMENTS

| | | | |
|---|---|---|---|
| 395377 | 5/1992 | Austria . | |
| 0545250 | 6/1993 | European Pat. Off. . | |
| 716228 | 12/1931 | France . | |
| 2653310 | 4/1991 | France . | |
| 9419547 | 3/1995 | Germany . | |
| 197807 | 7/1978 | Switzerland | 280/11.22 |
| 8400501 | 2/1984 | WIPO . | |

*Primary Examiner*—J. J. Swann
*Assistant Examiner*—David R. Dunn
*Attorney, Agent, or Firm*—Wall Marjama Bilinski & Burr

[57] ABSTRACT

A combination boot and skate having an interfacing mechanism for releasably securing the plate of the skate to the sole of the boot. A rigid stirrup piece is rotatably mounted in the plate having a contour that complements that of the upper part of the boot. The stirrup is rotatable to a boot engaging position and held in that position by a releasable lock to restrain the boot against lateral and longitudinal movement when the skate is in use.

19 Claims, 10 Drawing Sheets

ROLLER OR ICE SKATE

TECHNICAL FIELD

The invention relates to a roller or ice skate which has a structure that facilitates automatic boot engagement, improving the practice of skating.

PRIOR ART

Traditional roller skates, in particular as they are described in document FR 2,286,667, generally consist of a plate which supports rollers and on which straps for temporarily securing the boot are mounted. Although making it possible to use non-specific boots, these roller skates have the major drawback of requiring the user to adjust the straps each time the boot is engaged, which may prove tedious and inconvenient. A structure of this type is found in the device, similar to roller skates, as it is described in patent EP 0,334,783.

A first problem which the invention therefore proposes to solve is that of automatically engaging the boot of a roller skate.

Solutions have been proposed to facilitate the boot engagement method, in particular by using skates as described in patent CH 602,147. Unfortunately, although this device does away with some of the boot attachment straps and replaces them by a mechanism similar to the one used in certain ski bindings, it nevertheless has the drawback of not laterally supporting the leg and of therefore making the skating less efficient.

A second problem which the invention therefore proposes to solve is that of supporting the foot laterally and longitudinally.

It has also been proposed, in document FR 716,228, to equip a roller skate plate with lateral uppers which rise as far as the bottom of the calf and are held there using a sheath laced around the calf. Quite clearly, a structure which is reinforced in this way is uncomfortable for the user and proves time-consuming to put on. Furthermore, as regards the user's safety, a structure of this type does not prevent the ankle from tilting backward, and therefore impairs dynamic support when the skater accelerates.

A third problem which the invention therefore proposes to solve is that of ensuring good transfer of the forces needed for competitive roller skating.

Moreover, the Applicant has described, in patent application FR 96.11345 which was not yet published on the filing date of the present application, an automatic snap-fastening system allowing a flexible boot to be attached to a roller skate plate. Although satisfactory in terms of secure attachment, the solution described in this document does not allow optimum dynamic support.

The object of the invention is therefore to provide a roller skate which is easy to engage with the boot and can be used with flexible boots which are comfortable to walk in when the user has taken off his skates and which, when the skate is engaged and locked, allow the ankle to be supported dynamically during the propulsion phase.

In the rest of the description, the invention will be described more particularly in its application to a roller skate, but the way in which it can be adapted to an ice skate is readily apparent to the person skilled in the art without special modification.

SUMMARY OF THE INVENTION

The invention therefore relates to a boot/skate combination comprising:

a boot consisting of a bottom part and a flexible upper, a skate which is formed by a plate for supporting a plurality of rollers or a blade, and by a rigid rear stirrup piece which can interact with the user's lower leg.

This combination is one wherein:

the interface between the boot and the plate comprises:

on the one hand on the plate, means allowing automatic boot engagement by snap-fastening of the lower face of the bottom part of the boot, on the lower face of the bottom part of the boot, complementary means for interacting with the snap-fastening means of the plate, on the other hand the rigid stirrup piece which is articulated with respect to the plate and has general internal shapes complementary with the external shapes of the flexible upper in order to hold it when it is positioned on the plate, with the user's foot in place in the boot;

and the bottom part of the boot comprises a sole which makes it possible to walk while also incorporating the snap-fastening means.

In this way, when engaging a boot with the skate according to the invention, the plate is secured to the boot, and at the same time means which transmit forces are fitted in place, these means consisting of the characteristic stirrup piece.

In order to ensure that the boot is secured properly to the plate, and to allow interaction with the characteristic stirrup piece, the means for automatic boot engagement are located level with the region of the boot that houses the arch of the foot.

In a first embodiment, the rigid stirrup piece is articulated onto the plate and joins the two lateral sides of the plate adjacent with the foot arch recess while passing over the region of the wear's foot and while holding the upper above the heel.

In a second embodiment, the rigid stirrup piece forms a spoiler and joins the two lateral sides of the plate, also level with the arch of the foot, and by means of a frame forming an upward extension of the plate.

Advantageously, in practice, the stirrup piece which forms a spoiler is secured to the boot and locks in position on the plate when the boot is engaged with the skate.

In a preferred form, the rigid stirrup piece is cut level with the Achilles tendon to constitute two lateral branches joined by a buckle, or more generally by a device making it possible to tighten the two branches after the stirrup piece has been fitted in place.

In a third embodiment, the rigid stirrup piece includes a first portion oriented in the direction of the malleoli, and a second portion which extends the first portion and is oriented toward the front of the lower leg, as well as a strap which joins the portions while passing behind the Achilles tendon and over the heel.

In practice, the rigid stirrup piece can be folded down onto the plate in order to be retracted when the skate is being stored and transported, in order to reduce its overall bulk.

In an advantageous form, the rigid stirrup piece includes means for temporarily securing it to the upper of the boot.

In a practical form, the temporary securing means consist of studs which are arranged on the top of the upper, above the boot wearer's calcaneus and close to the Achilles tendon, and are intended to interact with complementary holes which are formed for this purpose on the lower face of the corresponding part of the rigid stirrup piece.

In an alternative embodiment, in order to improve the lateral support of the ankle, the stirrup piece may advantageously included a widened region level with the malleoli.

In practice, the rigid stirrup piece is asymmetric with respect to the longitudinal mid-plane of the plate, in order to accommodate for the location of the forces during thrusting.

Thus, the side lying inward with respect to the foot may be higher than the one lying outward.

In a particular embodiment, the rigid stirrup piece is formed by two main branches, at least one of which having means for locking closed the means for snap-fastening the boot onto the plate. In other words, fitting the stirrup piece in place thus locks the snap-fastening means in position, preventing any sudden release of the plate.

In an alternative embodiment, the branches of the stirrup piece have slots which coincide with ventilation regions formed in the flexible upper.

The invention preferably relates to in-line roller skates. In this case, it may prove advantageous if the rigid stirrup piece is articulated onto the actual axle of one of the wheels which is itself secured to the plate.

BRIEF DESCRIPTION OF THE DRAWINGS

The way in which the invention may be embodied, and the advantages which result therefrom, will emerge clearly from the description of the embodiments which follow, supported by the appended drawings, in which.

EMBODIMENTS OF THE INVENTION

Figure 1:
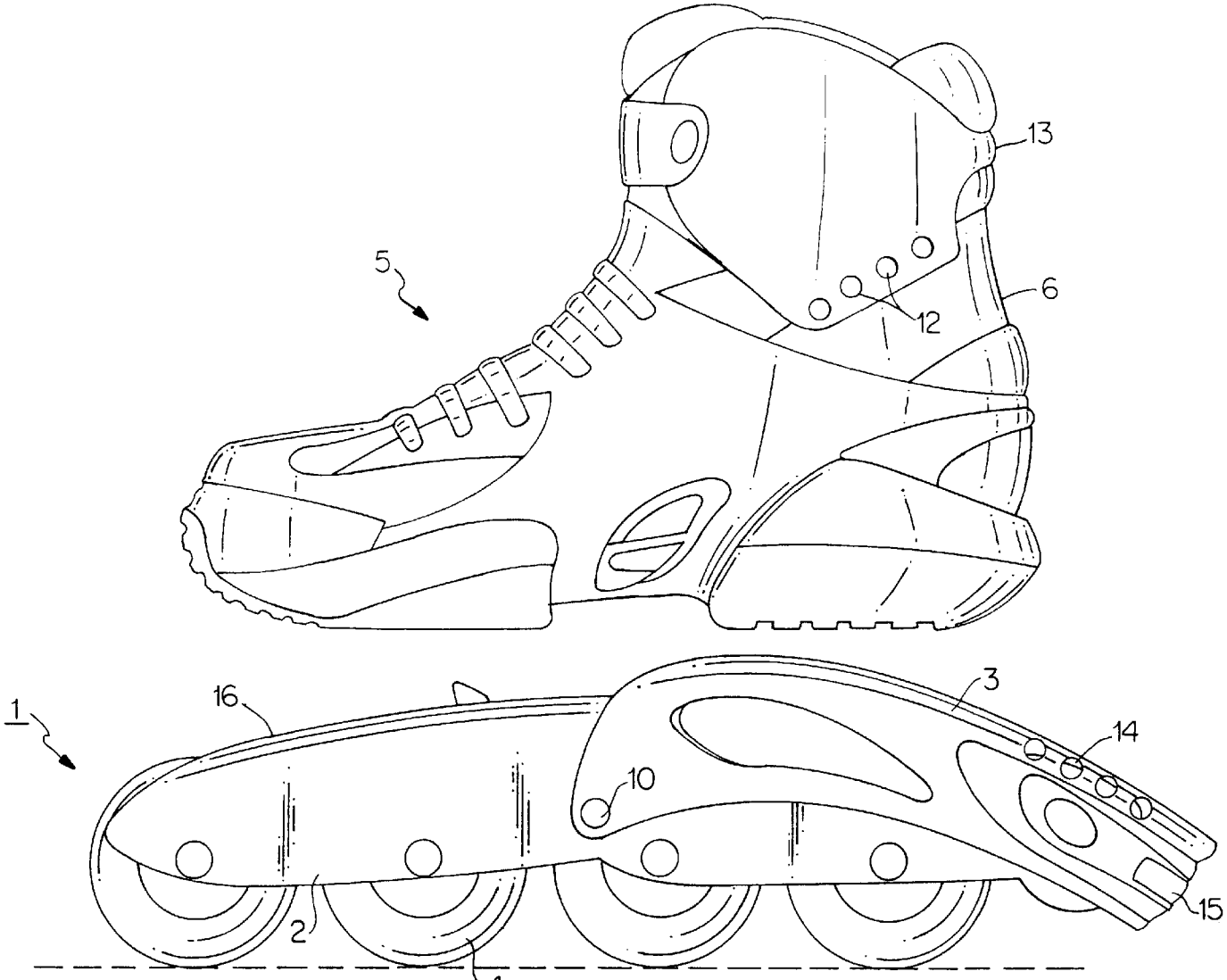
FIG. 1 is a side view of a skate and of a boot which are in accordance with the invention but are not yet assembled with one another.
Figure 2:
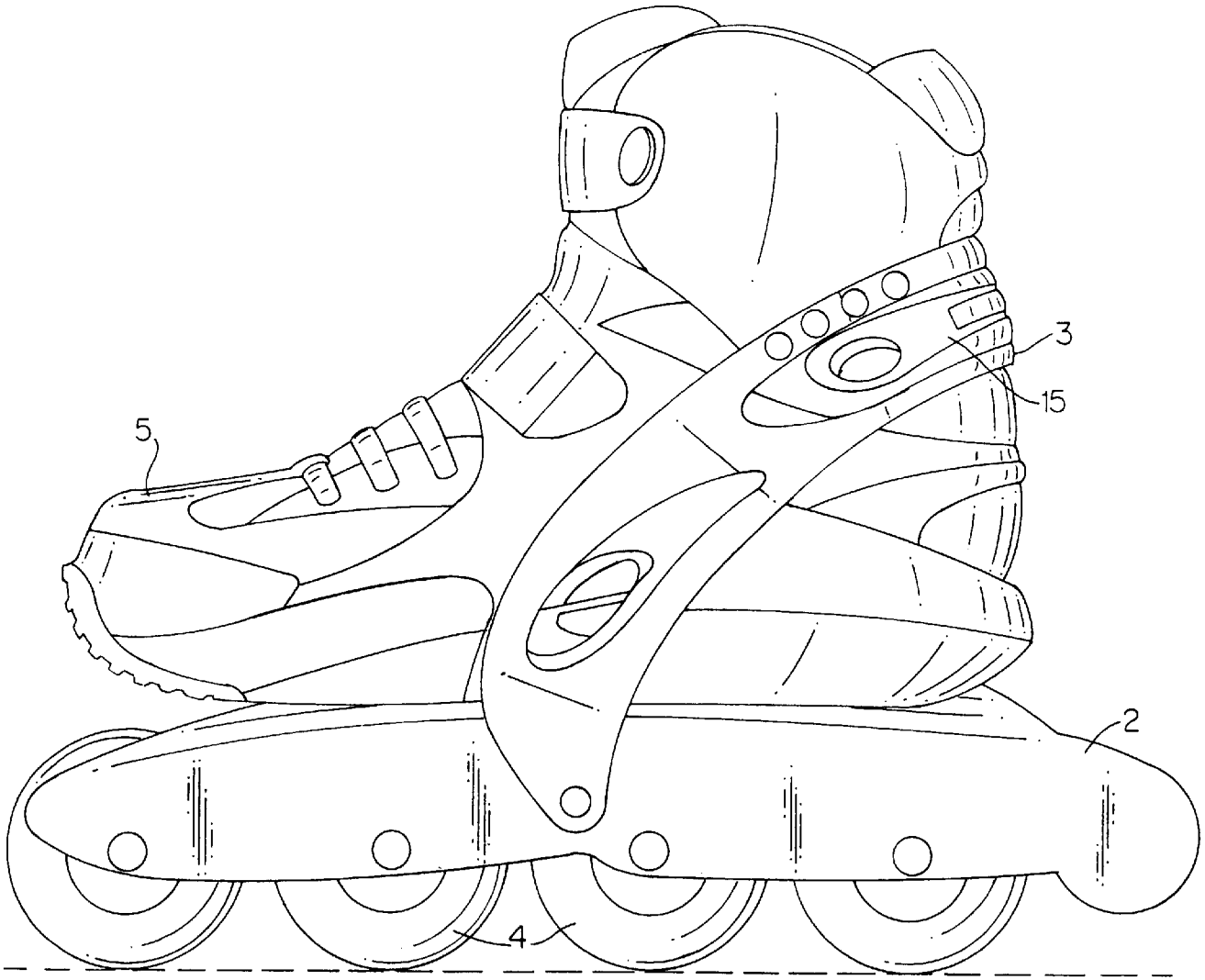
FIG. 2 is a side view of the boot mounted on the skate in FIG. 1.
Figure 3:
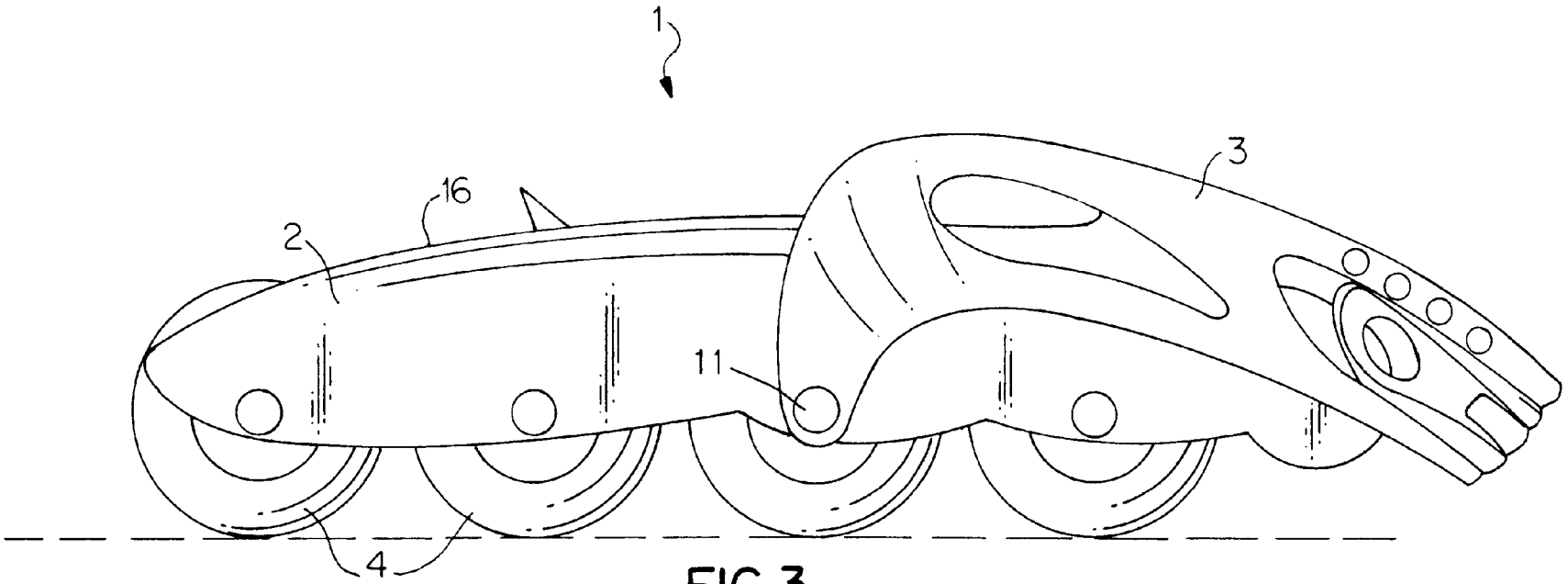
FIG. 3 is a side view of a plate in which the stirrup piece is articulated onto a wheel axle.

As can be seen in FIGS. 1, 2, and 3, the skate (1) according to the invention is essentially composed of a plate (2) supporting the rollers (4), and of a stirrup piece (3) which passes behind the heel level with the calcaneus of a person who is using the skate. This skate (1) is intended to accommodate a flexible boot (5).

According to a first feature of the invention, the rigid stirrup piece (3) is articulated onto the plate (2) and has a general shape that is complementary with an external shape of the upper (6) of the boot (5), in order to hold it when it is positioned on the plate (2), with the user's foot in place in the platform forming the top surface 16 (FIG. 1) of the boot (5). This stirrup piece may be articulated at a pin (10) mounted on the plate, as illustrated in FIGS. 1 and 2, or alternatively may be articulated directly onto an axle (11) of a roller (4) (FIG. 3).

In general, the rigid stirrup piece (3) joins the two lateral sides of the plate (2) substantially level with the recess for the arch of the foot.

According to another feature of the invention, and as illustrated in FIGS. 1 and 2, the branches of the stirrup piece (3) have shapes which are complementary with that portion of the boot (5) which they are intended to face, in order to carry out temporary and releasable securing.

In the form illustrated in FIGS. 1 and 2, this securing is obtained by a set of studs (12) which protrude from a semi-rigid region (13) of the upper (6). These studs (12) are intended to penetrate holes (14) made on each of the branches of the stirrup piece (3). Quite clearly, the invention is not limited to this form which has been represented, but encompasses the variants in which the studs are located on the stirrup piece and penetrate accommodating parts (not shown) of the upper (6), or alternatively hybrid variants. The holes (14) in the stirrup piece (3) may also be blind holes, without departing from the scope of the invention. More generally, the spirit of the invention will be adhered to so long as the boot interacts with the stirrup piece. The attachment point may also be located level with the boot weaer's Achilles tendon.

In an advantageous form, in order to make it easier to fit a stirrup piece of this type in place, and in particular the temporary securing region, the stirrup piece (3) is split level with the boot wearer's Achilles tendon region of a person wearing the boot in order to make it possible for the two branches of the stirrup piece to be moved apart when it is raised or lowered.

In the embodiment represented in FIG. 2, the two branches of the stirrup piece (3) are joined by a buckle (15), or any other attachment means which makes it possible to bring the two branches of the stirrup piece together and hold them against the corresponding region (13) of the boot. This tightening means may be produced in various ways, that is to say by means of a buckle (15), as represented, and also by means of a strap or any other equivalent means (not shown).

Figure 4:
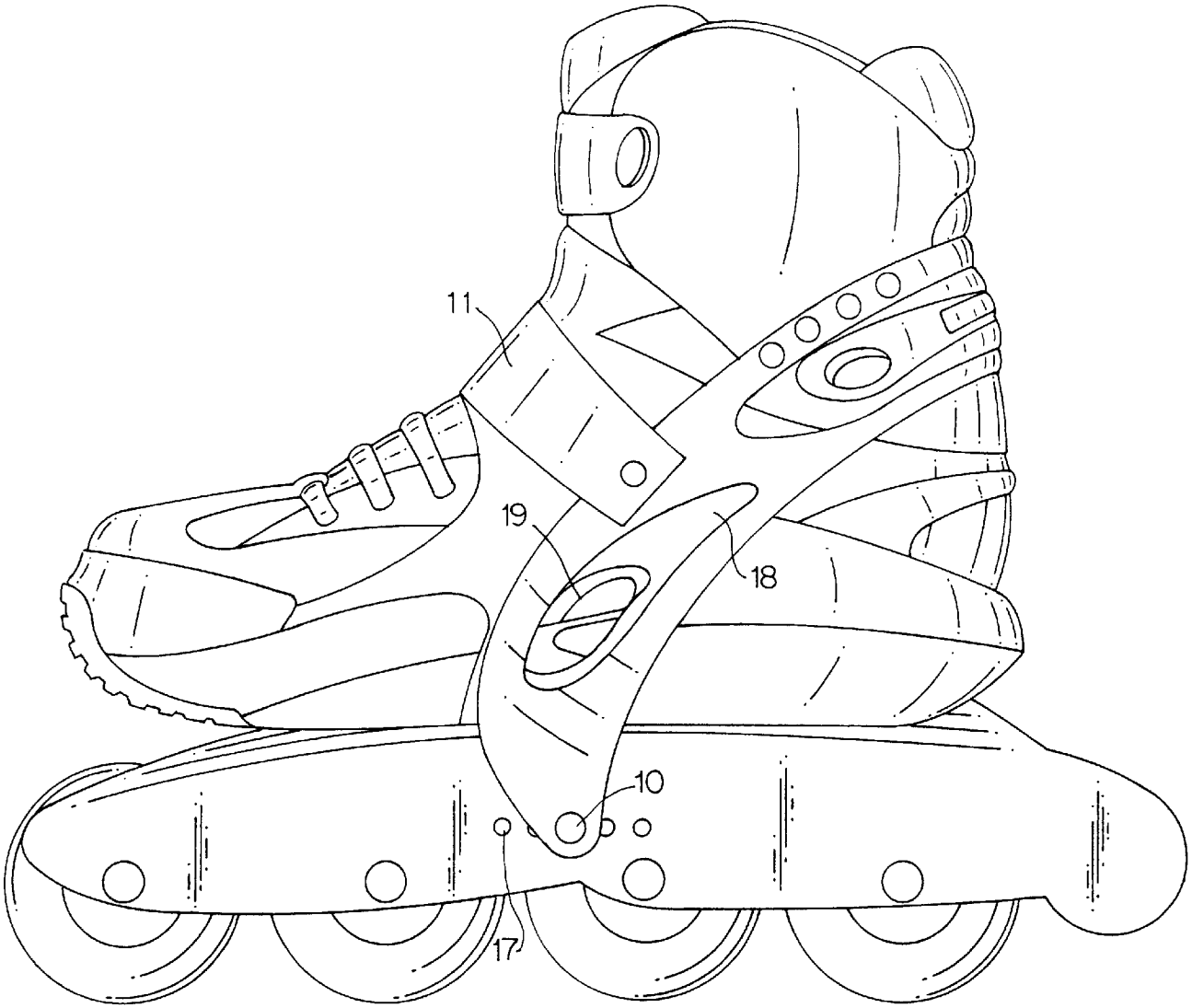
FIG. 4 is a side view of a combination according to the invention, in which the stirrup piece can be adjusted longitudinally.

As illustrated in FIG. 4, the position of the stirrup piece, and more precisely the pin (10) by which it is articulated with respect to the plate (2), can be adjusted longitudinally. In practice, the plate has a plurality of accommodating parts (17), in which the male part of the articulation pin (10) of the stirrup piece (3) can be accommodated.

Of course, the invention is not limited to adjustment means involving a plurality of pierced holes, as is illustrated in FIG. 4, but encompasses all variants which, in particular, allow fine and precise positioning of the stirrup piece (3) with respect to the plate (2). Mention may, in particular, be made of means which allow twofold adjustment, lengthwise and heightwise, for example using double crossed slots (not shown).

As can also be seen in FIG. 4, the stirrup piece (3) may have a slot (18). This slot (18) faces openworked regions (19) of the boot (5) which ventilate the user's foot.

In an embodiment which is shown in FIG. 4, the stirrup piece (3) may have an additional strap 11 which joins its two branches, starting from central attachment points and passing over the wearer's instep, so as to hold the foot properly, especially as regards the lateral forces exerted during the propulsion phases. This strap may be equipped with tightening means (not shown) of the hook or Velcro® type.

Figure 8:
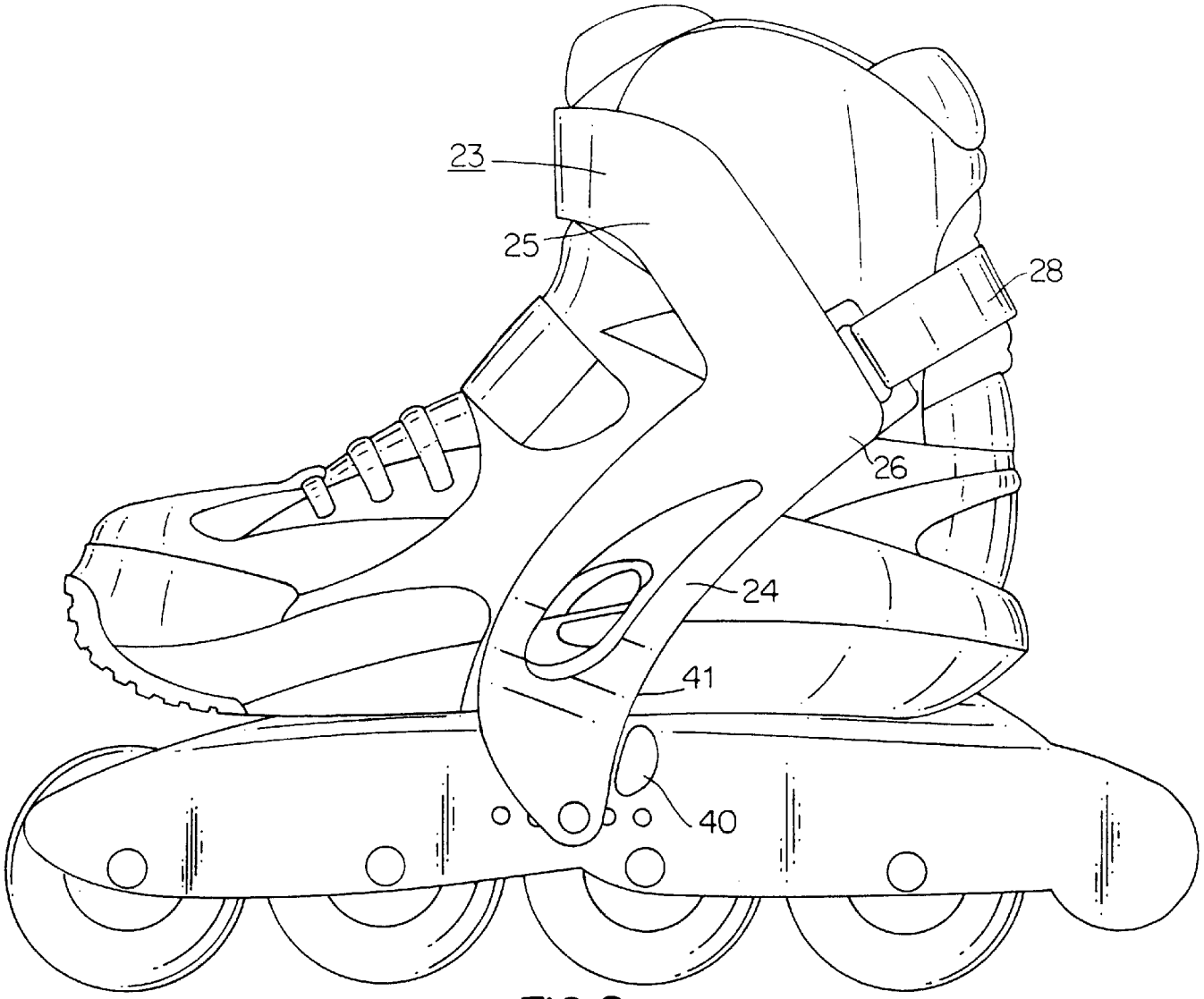
FIG. 8 is a side view of an alternative embodiment.

In the form illustrated in FIG. 8, the stirrup piece (23) is different. On each side of the boot, this stirrup piece (23) consists of a branch consisting of a first rigid portion (24) which is articulated onto the plate (2), level with the articulation pin (10), and extends to the region of the boot that encloses the malleoli of one wearing the boot region. This first portion (24) continues forward in a second rigid portion (25) which is oriented in the direction of the lower leg, above the instep. This second portion (25) may be continuous from one side of the boot to the other, forming only a single piece, or may be independent and joined by a tightening strap (not shown) or buckle similar to that shown at 11 in FIG. 4.

Further, the free end (26) of the branch (24) is joined to a strap (28) which passes around the rear of the foot, level with the boot wearer's Achilles tendon. This strap may be equipped with any tightening means, as already mentioned.

As already stated, the stirrup piece (3) may be asymmetric with respect to the mid-plane of the skate, that is to say it may have different shapes on the inside and outside of the skate. Thus, this stirrup piece (3) may have a larger area on the inside of the skate, thus allowing better dynamic support.

Figure 5:
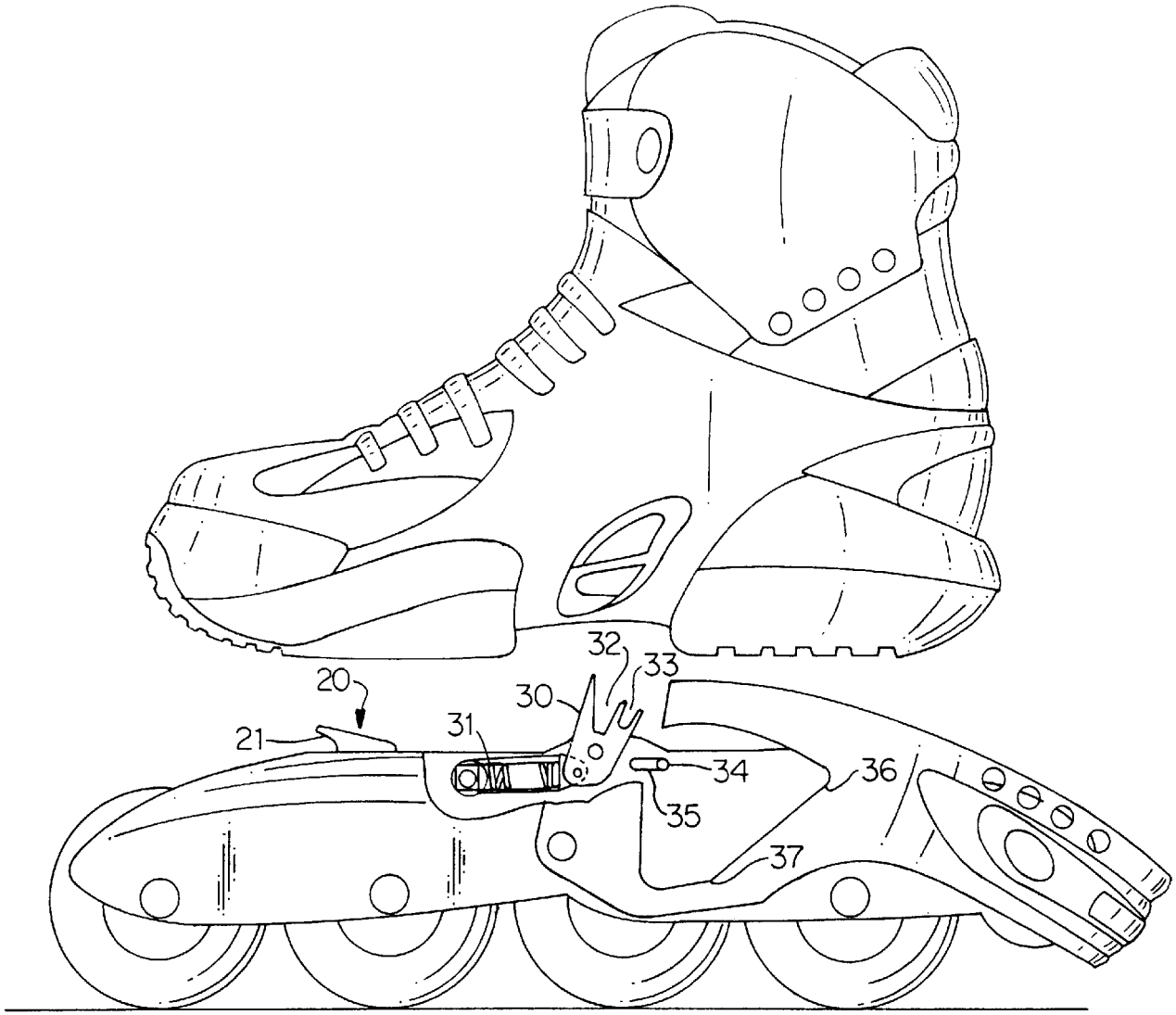
FIG. 5 is a side view of a combination according to the invention, in which the snap-fastening means are shown in cut-away before the boot is fitted in place.
Figure 6:
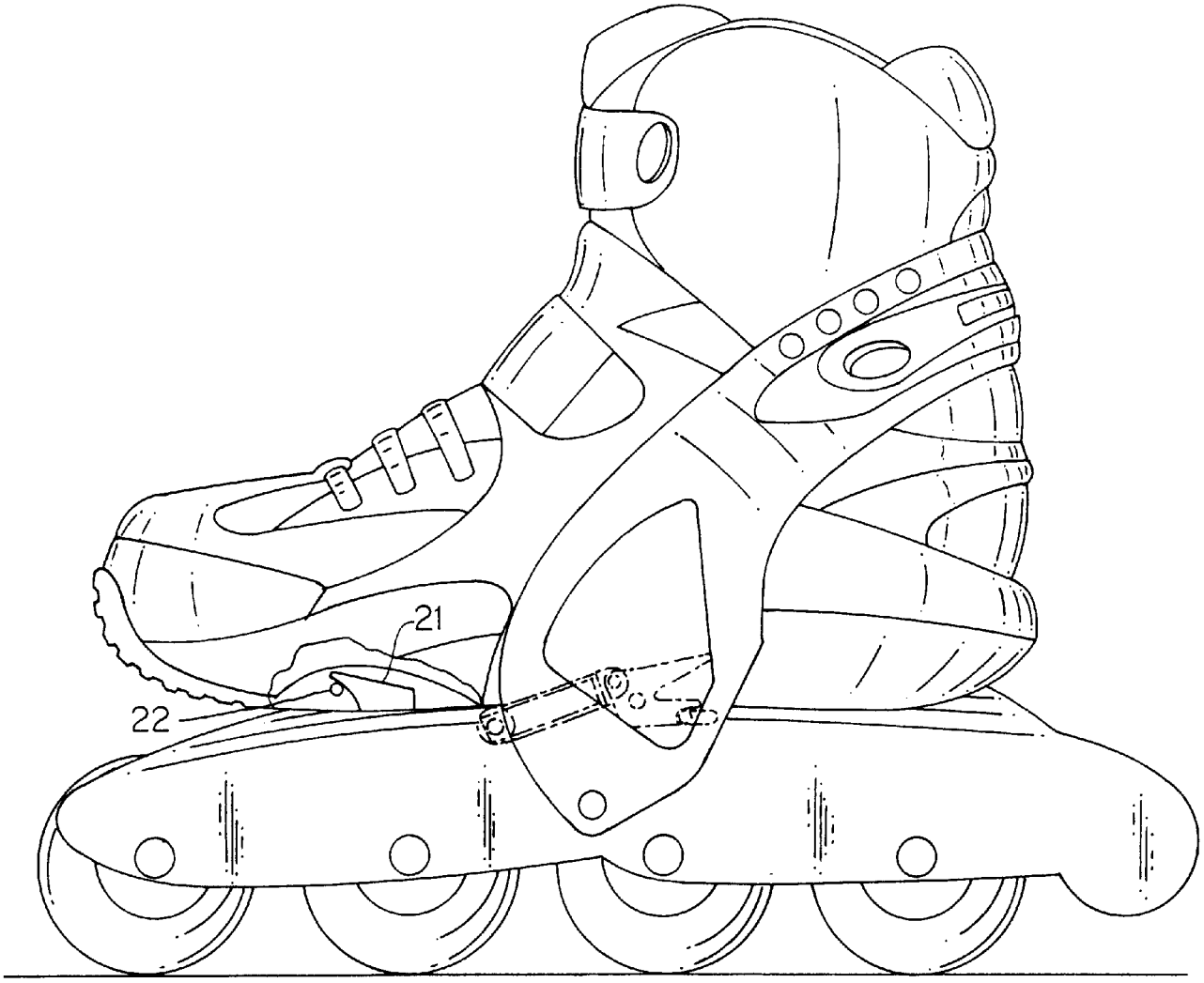
FIG. 6 is the same side view, in which the boot is secured to the plate.

According to another essential feature of the invention, the plate (2) is equipped with means (20) allowing the boot to be engaged automatically by snap-fastening. An illustrative embodiment of these means is represented in FIGS. 5 and 6. These means (20) consist of an attachment region (21), located at the front, substantially level with the metatarsophalangeal joint, and of a mechanism which is located level with the arch of the foot. At the front, the attachment region includes a hook (21) which is secured to the plate, is oriented towards the front and is intended to interact with a transverse pin (22) secured to the sole of the boot.

Level with the recess for the arch of the foot, the attachment mechanism consists of an articulated piece (30) associated with a spring (31). Together the pieces (30, 31) constitute a bistable latch as described in the Applicant's application FR 96.11335, not yet published at the filing date of the present application, so neither the architecture nor the operation of these means need be described in more precise detail here. Nevertheless, it may be pointed out that the piece (30) has an accommodating part (32) in which a corresponding part of the boot is intended to engage.

Further, this piece (30) has means for locking it in the immobile position, in order to prevent any sudden detachment of the plate.

In practice, as illustrated in FIG. 5, these means consist of a groove (33) which is formed in the piece (30) and can accommodate a sliding pin or stop (34) that is free to move longitudinally in a slot (35) provided for this purpose in the plate. This stop may advantageously include an elastomer block, in order to make the rearward support more elastic and more comfortable.

Advantageously, the stirrup piece (3) has an openworked region (36) in its bottom part, one of the edges (37) of which region can come into contact with the pin (34) and compel it to enter the groove (33) when the stirrup piece is in the raised position, corresponding to the skate being used. Thus, in practice, when the user has engaged the boot on the plate, the simple act of raising the rear stirrup piece allows him to lock the snap-fastening system (20) and prevent any sudden disengagement.

Figure 10:
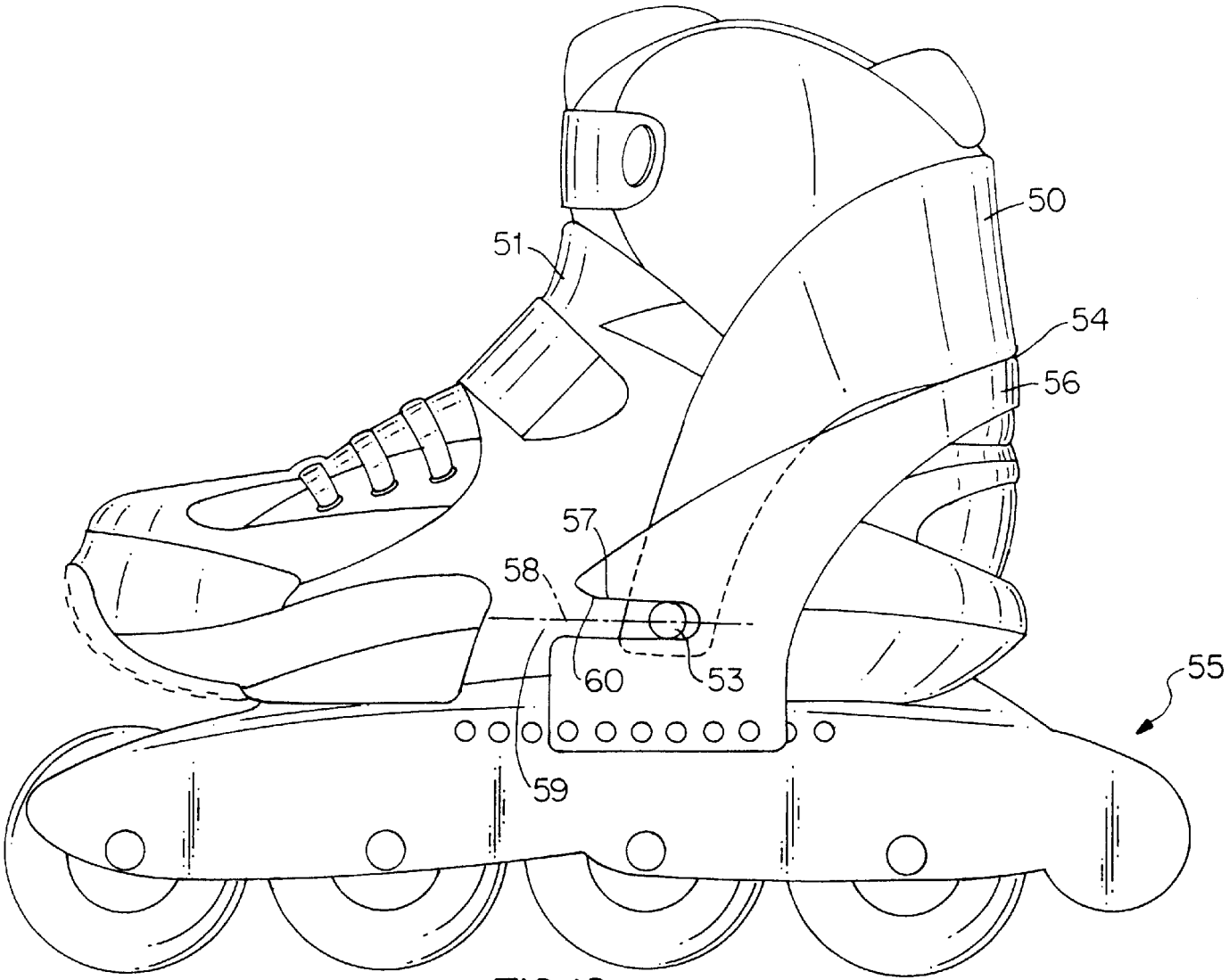
FIG. 10 is a side view of the boot in FIG. 9, engaged on a plate according to the invention.

According to another feature of the invention, the plate includes a stop (40), illustrated in FIG. 8, making it possible to limit the amplitude of the rearward. As shown in FIG. 10, the spoiler is adapted to rest in top of the frame along a line of contact 54. Movements of the stirrup piece (3). This makes it possible to accommodate rearward forces, since the stirrup piece (3) constitutes a fixed point when its rear contour (41) comes into contact with the stop (40).

In practice, this stop (40) can be retracted at the rear of the plate in order to allow the stirrup piece (3) to tilt rearward.

Figure 7:
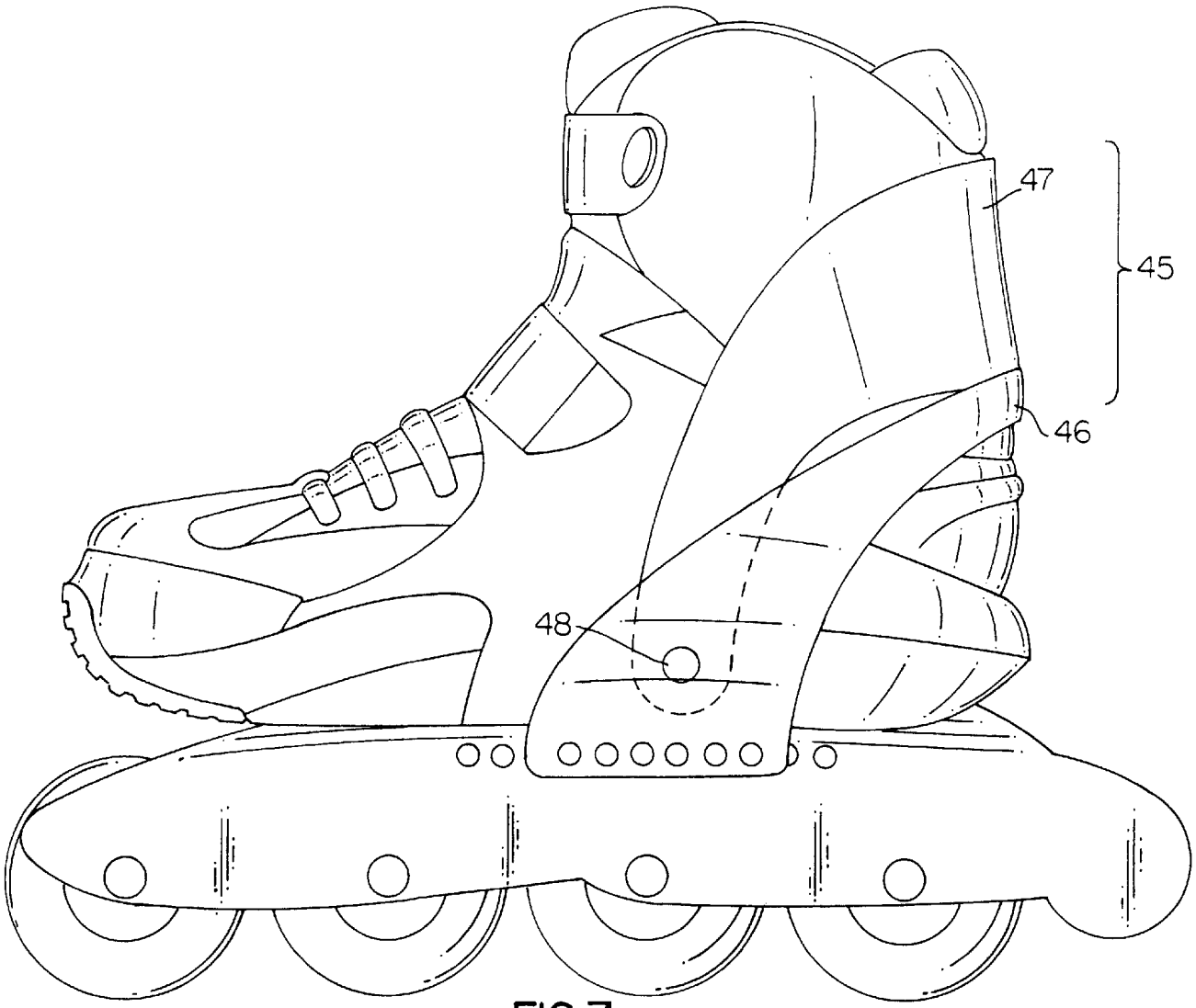
FIG. 7 is a side view in which the stirrup piece consists of two separate parts.

In the form illustrated in FIG. 7, the stirrup piece (45) consists of the association of a frame (46) on which a spoiler (47) is mounted. The frame (46) is fixed with respect to the plate (2) and joins the two sides of the recess for the arch of the foot, passing around the Achilles tendon, level with the calcaneus. The spoiler (47) which is associated with it is articulated onto the frame (46) level with an articulation pin (48) located as close as possible to the bottom end of the frame (46). This pin (48) can be adjusted in a position on the frame. When it is in the active position, that is to say resting on the frame (46), this spoiler (47) rises as far as the top part of the upper of the boot (5). It extends forward to cover a maximum area, this being beneficial to the transfer of forces.

In the advantageous form illustrated in FIG. 7, the position of the stirrup piece (45) can be adjusted on the plate (2) in order to adapt to different boot sizes.

Figure 9:
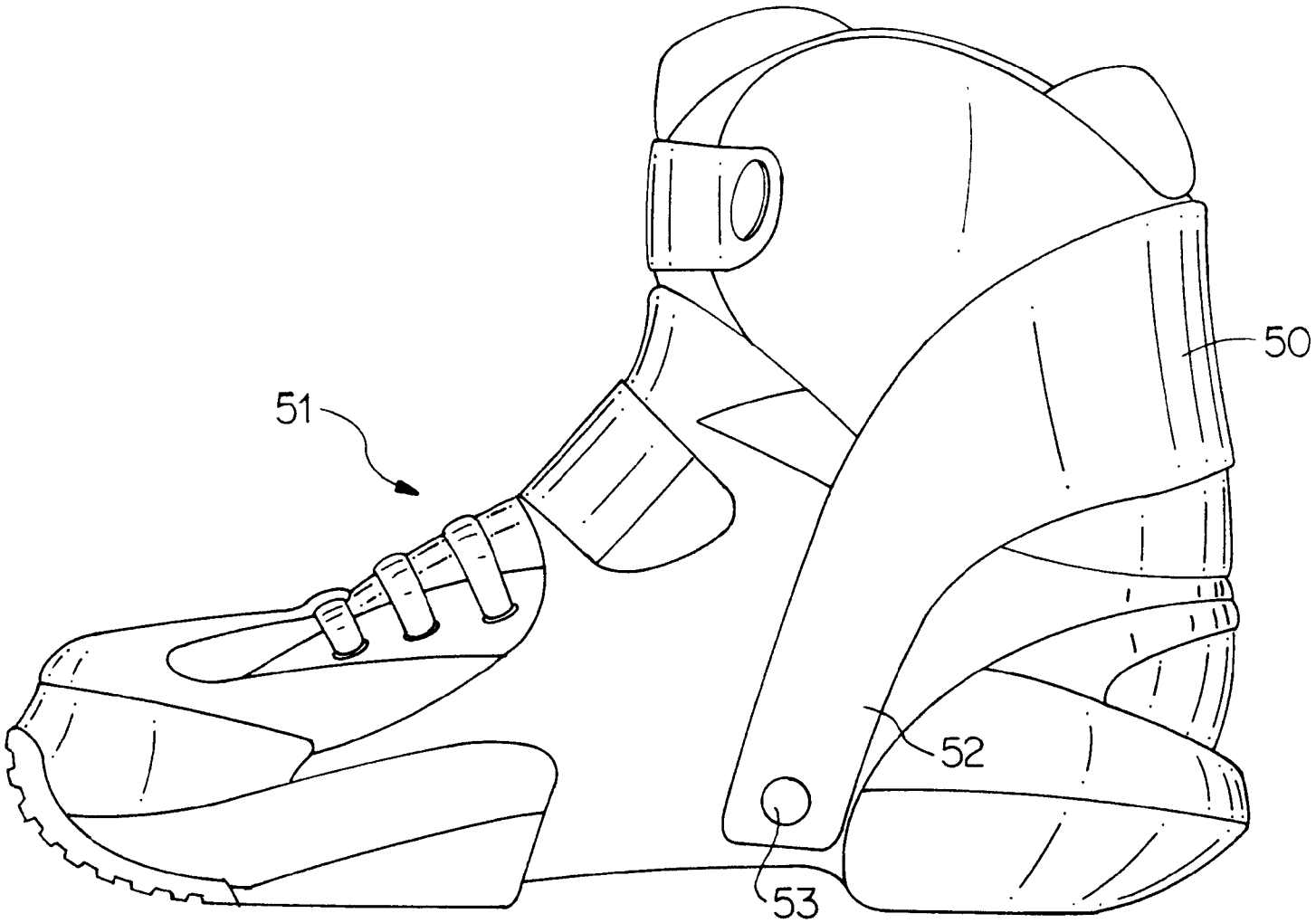
FIG. 9 is a side view of a boot according to an alternative embodiment.

In the form illustrated in FIG. 9, the stirrup piece (50) is secured to the boot (51). More precisely, this stirrup piece (50) has two branches (52), extending laterally and downward at the malleoli and meeting behind the Achilles tendon, above the calcaneus.

This stirrup piece (50) is articulated with respect to the boot by means of pivots (53) or pins which allow the stirrup piece (50) to tilt rearward.

In the walking position, this stirrup piece, or spoiler (50), does not stiffen the boot, which retains the qualities of flexibility which are appreciated when walking.

This flexible boot (51) is intended to be mounted on an appropriate plate, illustrated in figure (10). Thus, in its central part, this plate (55) comprises a frame (56) similar to the frame (46) illustrated in FIG. 7. The longitudinal position of this frame (56) can be adjusted along the plate (55).

This frame (56) joins the edges of the plate by passing over the heel of the boot (51). This rigid frame (56) has a pair of accommodating parts (57) close to the region where it is attached onto the plate (55). These accommodating parts (57) have a substantially horizontal axis (58) and open toward the front of the frame.

This accommodating part (57) is intended to receive the pivots (53) located level with the arch recess of the boot. Thus, when the boot is engaged, the user positions the boot (with respect to the plate in such a way that the pivots (53) are at the entry (59) of the accommodating parts (57). A chamfered portion (60) may advantageously in practice make it easier to engage the boot without looking. When the pivot (53) is engaged in the accommodating part (57), the user moves his foot rearward in order, on the one hand, to operate the system (not shown) for automatically attaching the boot to the plate and, on the other hand, to bring the pivot (53) to the end of the accommodating part (57). In this way, the interaction of the stirrup piece (50) and the frame (56) prevents any lateral movement of the boot. This transverse rigidity is particularly appreciated in competitive roller skating.

Further, the bottom part of the stirrup piece (50), level with the Achilles tendon, comes into contact with the frame (56), preventing any rearward pivoting of the stirrup piece (50).

Means for temporarily securing the stirrup piece (50) to the frame (56), level with the Achilles tendon, may also be provided.

The above description shows that the skate according to the invention has the following advantages:

it makes it possible to use boots which are flexible and comfortable for walking, when the user has taken off his skates, it is particularly easy to engage the boot, it ensures optimal holding of the ankle during propulsion, as well as good dynamic support.

What is claimed is:

1. A combined boot and skate that includes a boot having a bottom part that includes a sole and an upper that houses a wearer's foot and lower leg, said boot having a heel region and arch region that encloses the wearer's arch recess, a skate that includes a plate having a platform upon which said boot rests and opposed lateral side walls that extend downwards below the platform beneath the arch region of the boot and a skating means, a snap fastener means that coacts between the sole of the boot and the plate, said fastener means adapted to automatically close about a transverse pin recessed in the sole of the boot, and a rigid stirup having a pair of branches, each branch being supported at its proximal end in one of the opposed sidewalls of said plates immediately beneath the arch region of the boot, each branch extending upwardly along the arch region of the boot and passing over a region of the boot that houses the wearer's calcaneus, each branch further including an arcuate section at its distal end that passes around the back of the boot over the heel region so that said snap fastener and said branches cooperate to securely hold the boot against the platform of said plate.

2. The combination of claim 1 further including a spoiler having opposed ends, each of which is connected to one of said stirrup branches, said spoiler being arranged to pass around the back of the boot on top of said arcuate shaped section of the stirrup.

3. The combination of claim 2 wherein each end of said spoiler is joined to one side of said branches by a pivot whereby the spoiler can rotate about said pivot.

4. The combination of claim 1 that further includes a spoiler that is arranged to pass around the back of the boot over said arcuate shaped section of the stirrup and each end of said spoiler is joined to one side of said boot by a pivot, each pivot further being received in a slotted opening in one of said stirrup branches to secure the spoiler in the stirrup when the boot is mounted upon said plate.

5. The combination of claim 1 wherein the arcuate section of the stirrup is separated into two lateral half sections and further includes an adjustable buckle means for joining said half sections.

6. The combination of claim 1 wherein said snap fastening means is located beneath the arch recess region of the boot.

7. The combination of claim 1 that further includes a strap means that passes over the instep of the boot and said strap means having ends that are attached to the branches of the stirrup.

8. The combination of claim 1 wherein each branch of said stirrup is rotatably supported in a lateral side wall of the plate so that the stirrup can be rotated from a raised boot engaging position downwardly to a second lower position adjacent the plate whereby the plate can be more easily stored.

9. The combination of claim 8 wherein said plate further includes a stop means for limiting the rearward travel of said stirrup when said stirrup is in said raised position.

10. The combination of claim 9 wherein said stop means is retractable out of a stop position whereby the stirrup can be rotated downwardly over the retracted stop.

11. The combination of claim 1 that further includes means for releasably securing the stirrup to the boot upper.

12. The combination of claim 11 wherein said means for releasably securing the stirrup includes studs that are aligned upon the boot above the region of the boot that houses the wearer's calcaneus, said studs being receivable in holes formed in said stirrup.

13. The combination of claim 1 wherein the branches of the stirrup are adjustably mounted upon the lateral side walls of the plate below said platform.

14. The combination of claim 1 that further includes locking means associated with said stirrup for locking said snap fastening means in a closed position about the transverse pin.

15. The combination of claim 1 wherein said stirrup has slotted holes therein which overlie ventilation means in said boot.

16. The combination of claim 1 wherein said skating means includes in-line wheels supported in said plate.

17. The combination of claim 16 wherein the branches of the stirrup are rotatably mounted upon a wheel axle.

18. A combined boot and skate that includes:

a boot having a bottom part that includes a sole and an upper that houses a wearer's foot and lower leg, said boot having a heel region that encloses the back of the wearer's heel and an arch region that encloses the wearer's arch recess, a skate that includes a plate having a platform upon which the sole of the boot rests and opposed lateral side walls that extend downwardly along each side of the platform beneath the arch region of the boot, a snap fastener means that coacts between the sole of the boot and the platform that automatically closes about a recessed pin in the sole of the boot to properly position and secure the boot upon the platform, and a rigid stirrup having a pair of branches, each branch being supported at its proximal end in one of the sidewalls below the platform immediately beneath and adjacent to the arch region of the boot, each branch extending upwardly along the arch region of the boot and passing over a region of the boot that houses the wearer's malleoli, each branch further including an arcuate section at its distal end that passes over a boot instep so that said branches cooperate to hold the boot securely against the platform.

19. The combination of claim 18 that further includes a strap having two ends, each end being attached to said stirrup and said strap passing around the back of the boot over the heel region.

* * * * *